United States Patent [19]

Cherry

[11] 4,020,304

[45] Apr. 26, 1977

[54] TWO-MATERIAL VAPOR SHIELD FOR VACUUM-TYPE CIRCUIT INTERRUPTER

[75] Inventor: Sidney J. Cherry, Elmira, N.Y.

[73] Assignee: Westinghouse Electric Corporation, Pittsburgh, Pa.

[22] Filed: Jan. 6, 1976

[21] Appl. No.: 646,792

Related U.S. Application Data

[63] Continuation of Ser. No. 274,699, July 24, 1972, abandoned.

[52] U.S. Cl. ..... 200/144 B; 200/305

[51] Int. Cl.[2] ..... H01H 33/66

[58] Field of Search ..... 200/144 B, 305

[56] References Cited

UNITED STATES PATENTS

| | | | |
|---|---|---|---|
| 3,163,734 | 12/1964 | Lee | 200/144 B |
| 3,366,762 | 1/1968 | Smith, Jr. | 200/144 B |

FOREIGN PATENTS OR APPLICATIONS

| | | | |
|---|---|---|---|
| 767,772 | 9/1967 | Canada | 200/144 B |
| 1,136,510 | 12/1968 | United Kingdom | 200/144B |
| 261,513 | 12/1970 | U.S.S.R. | 200/144 B |

*Primary Examiner*—Robert S. Macon
*Attorney, Agent, or Firm*—W. G. Sutcliff

[57] ABSTRACT

A vacuum-type circuit interrupter is provided having a two-material vapor, or condensing shield for providing a high-conductivity material, such as copper, for the part that is exposed to the arc, and a superior high-voltage material, such as stainless steel, for the ends of the vapor or condensing shield.

Preferably, since the ends of the vapor shield are the origins of high-electric-field intensity, which may result in arcing in a vacuum, to avoid this, a superior high-voltage material, such as stainless steel, is provided.

3 Claims, 6 Drawing Figures

TWO-MATERIAL VAPOR SHIELD FOR VACUUM-TYPE CIRCUIT INTERRUPTER

This is a continuation of application Ser. No. 274,699, filed July 24, 1972, now abandoned.

CROSS-REFERENCES TO RELATED APPLICATIONS

Applicant is not aware of any related applications pertinent to the present invention.

BACKGROUND OF THE INVENTION

It has been customary in the design of vacuum-type circuit interrupters, to provide a vapor or a condensing shield to prevent the outward dissemination of the metallic particles during arcing, and their concomitant deposit on the inner walls of the outer insulating casing, which may be of glass or ceramic material, for example. Consequently, practically all vacuum-type circuit interrupters have such condensing shields.

Some of the shields may be disposed at the potential of one of the separable contacts, as in U.S. Pat. Nos. 2,975,256, Lee et al, or 3,244,842, Kameyama et al. Other condensing shields may, for example, be at a floating potential, such as set forth in U.S. Pat. No. 3,592,987, Lempert et al.

SUMMARY OF THE INVENTION

According to the present invention, the vapor or condensing shield is fabricated of a two-material, with the high-conductivity material such as copper, for example, provided for the part of the shield that is exposed to the arc, and a superior high-voltage material such as stainless steel for the ends of the aforesaid vapor or condensing shield.

Accordingly, it is an important object of the present invention to provide an improved vapor-condensing shield for a vacuum-type circuit interrupter, composed of two-materials, with a high-conductivity material such as copper, for the part exposed to the arc, and a superior high-voltage material such as stainless steel, for the ends of the shield.

Still another object of the present invention is to generally improve the structure and fabrication of vacuum-type circuit interrupters.

Further objects and advantages will readily become apparent upon reading the following specification taken in conjunction with the drawings.

DESCRIPTION OF THE PREFERRED EMBODIMENTS

Figure 1:
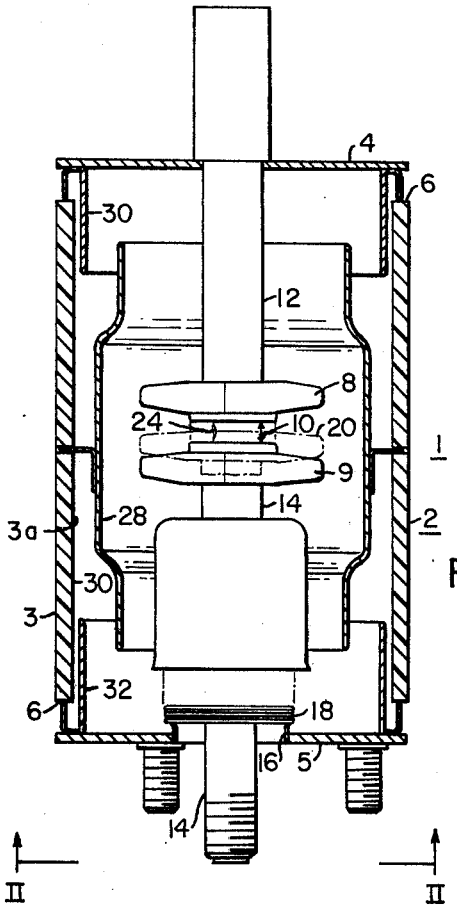
PRIOR ART FIG.1
FIG. 1 is a vertical sectional view of vacuum-type circuit interrupter embodying the principles of the present invention, the contacts being illustrated in the fully open circuit position.
Figure 2:
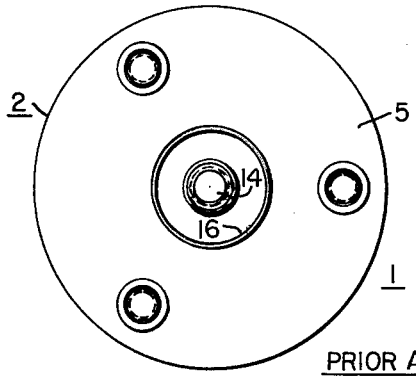
PRIOR ART FIG.2
FIG. 2 is a sectional view taken substantially along the line II—II of FIG. 1.
Figure 6:
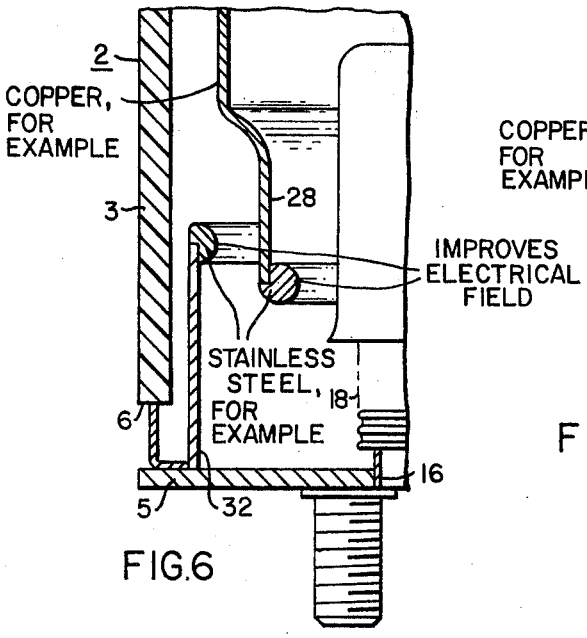
FIG. 6 is still another view of a modified-type of vapor shield having a solid rounded bead secured to the free end of the shield for electric field relieving purposes.

Referring to the vacuum-type circuit interrupter of FIG. 1, generally designated by the reference numeral 1, there is shown a highly-evacuated envelope 2 comprising a casing 3 of suitable insulating material, and a pair of metallic end caps 4 and 5, closing off the ends of the casing 2. Suitable seals 6 are provided between the end caps and the casing 2 to render the envelope vacuum-tight. The normal pressure within the envelope 2, under static conditions, is lower than $10^{-4}$ torr; so that reasonable assurance is had that the mean free path for electrons will be longer than the potential breakdown paths within the envelope 2.

Located within the envelope 2 is a pair of relatively movable contacts, or electrodes 8 and 9, shown in full lines in FIG. 1 in their separated or open-circuit position. When the contacts 8 and 9 are separated there is an arcing gap 10 located therebetween. The upper contact 8 is a stationary contact suitably secured to a conductive rod, or stem 12, which at its upper end is united to the upper end cap 4. The lower contact 9 is a movable contact joined to a conductive operating rod, or stem 14, which is suitably mounted for movement. The operating rod 14 projects through an opening 16 in the lower end cap 5, and a flexible metallic bellows 18 provides a seal about the rod, or stem 14, to allow for movement of the rod without impairing the vacuum inside the envelope 2. As shown in FIG. 1, the bellows 18 is secured in sealing relationship at its respective opposite ends to the operating rod 14 and to the lower end cap 5.

Coupled to the lower end of the operating rod 14, suitable actuating means (not shown) are provided for driving the movable contact 9 upwardly into engagement with the stationary contact 8, so as to close the circuit through the interrupter 1. The closed position of the movable contact is indicated by the dotted lines 20. The actuating means is also capable of returning the contact 9 to its illustrated solid-line open position, so as to open the circuit through the interrupter 1. A circuit-opening operation will, for example, entail a typical gap length, when the contacts 8 and 9 are fully separated, of perhaps ½ inch.

The arc, indicated at 24, that is established across the gap 10 between the electrodes 8 and 9, as the electrodes are opened, and also when they are closed, vaporizes some of the contact material, and these vapors are dispersed from the arcing gap 10 toward the envelope 2. In the illustrated interrupter 1, the internal insulating surfaces 3*a* of the casing 3 are protected from the condensation of arc-generated metallic vapor and particles thereon by means of a tubular metallic shield 28 suitably supported upon the casing 3, and preferably isolated from both end caps 4 and 5. This shield 28 acts to intercept and to condense arc-generated metallic vapors before they can reach the casing 3. To reduce the chances of vapor bypassing the shield 28, a pair of end shields 30 and 32 are provided at opposite ends of the central shield 28.

I have discovered that an important improvement may be made in the performance of vapor shields 28 for vacuum-type circuit interupters 1 by providing the vapor shield of a two-material, with the high-conductivity material, such as copper, for the part that is exposed to the arc, and a superior high-voltage material, such as stainless steel, for the end of the vapor or condensing shield.

The ends of the vapor shield are origins of high-electric-field intensity, which may result in arcing in a vacuum. To avoid this, a superior high-voltage material, such as stainless steel, which has a breakdown voltage of about three times that of copper, may be used for the whole shield, but these materials do not support as high an interrupting current as copper. Copper, accordingly, is preferably used if the ends are formed into a more generous radius, but because of limitation of space, a large radius may not always be accommodated. Accordingly, the present invention proposes that a two-material condensing shield will solve both the high-voltage and the high-current interrupting requirements of vacuum-type circuit interrupters.

Figure 3:
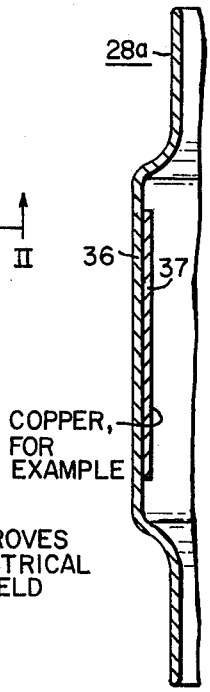
FIG. 3 is a sectional view of a vapor shield illustrating the electrical field at the ends of the vapor shield.

FIG. 1 illustrates a constructive in which the entire vapor shield 28 is provided of copper. FIG. 3 illustrates that the electrical field at the ends of the vapor shield 28*a* may be improved by the use of a two-material vapor shield, having stainless steel 36 disposed at the ends, and the copper 37 brazed to the stainless steel at the center, as illustrated in FIG. 3

Figure 4:
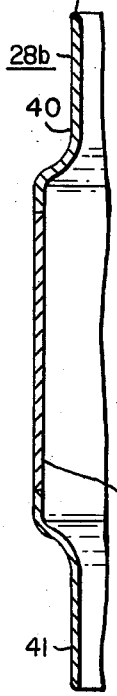
FIG. 4 is a similar view of an improved vapor shield in accordance with the principles of the present invention; and, FIG. 5 is another view of a modified-type of vapor shield according to the present invention.

FIG. 4 illustrates a modified-type of construction 28*b* in which copper is provided adjacent the central portion, and stainless steel 40, 41 is provided adjacent the ends of the modified condensing shield 28*b*.

Figure 5:
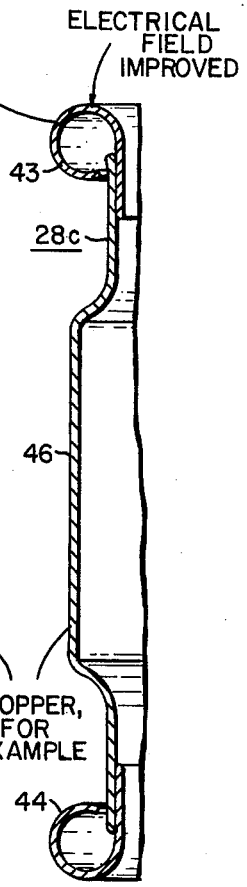

FIG. 5 illustrates still a further modified construction 28*c* in which large-end radius 43 is provided with similar radius 44 on the end shields. Preferably, copper is provided in the central portion of the shield 28*c*, as indicated by the reference numeral 46. Disposed at the ends, and having a somewhat larger radius is the stainless steel 43, 44 providing a field-relieving portion. Preferably the stainless steel is brazed to the central portion of copper 46.

Reference may be made to the following table I, setting for the voltages supported by various materials.

TABLE I

VOLTAGE INSULATED ACROSS 1 MM GAP (AFTER TRUMP[110])

| Polished and Spark Conditioned Electrodes | |
|---|---|
| Electrode Material | Voltage Insulated Across 1 mm Gap (kV) |
| Steel | 122 |
| Stainless Steel | 120 |
| Nickel | 96 |
| Monel Metal | 60 |
| Aluminum | 41 |

TABLE I-continued

VOLTAGE INSULATED ACROSS 1 MM GAP (AFTER TRUMP[110])

| Polished and Spark Conditioned Electrodes | |
|---|---|
| Electrode Material | Voltage Insulated Across 1 mm Gap (kV) |
| Copper | 37 |

From the foregoing description it will be apparent that there has been provided an improved two-material vapor-condensing shield 28, 28*a*, 28*b*, 28*c* for a vacuum-type circuit interrupter 1 to relieve the high-voltage stress areas at the ends of the shield.

Although there has been illustrated and described specific structures, it is to be clearly understood that the same was merely for the purpose of illustration, and that changes and modifications may readily be made therein by those skilled in the art, without departing from the spirit and scope of the invention.

I claim:

1. A vacuum-type circuit interrupter including in combination:

a. means defining an evacuated envelope;

b. a pair of separable contacts disposed within the evacuated envelope and separable to establish arcing;

c. a vapor-condensing shield provided interiorly within said evacuated envelope to prevent the deposition of metallic particles emitted from the arcing region toward the outer casing of the envelope; and, d. said vapor condensing shield being fabricated of two materials, a copper central shield portion about the arcing area, and opposed end shield portions at each end of the central shield portion formed of a metal having a higher breakdown voltage characteristic than copper, which metal is selected from the group of stainless steel, steel, nickel, Monel metal, and aluminum.

2. The combination of claim 1, wherein the metal is preferably stainless steel.

3. A vacuum-type circuit interrupter including in combination:

a. means defining an evacuated envelope;

b. a pair of separable contacts disposed within the evacuated envelope and separable to establish arcing;

c. a vapor-condensing shield provided interiorly within said evacuated envelope to prevent the deposition of metallic particles emitted from the arcing region toward the outer casing of the envelope; and, d. said vapor condensing shield comprising two materials, a central shield copper portion about the arcing area, and opposed stainless steel end shield portions at each end of the central shield portion.

* * * * *